US011373628B1

(12) United States Patent
Harris

(10) Patent No.: US 11,373,628 B1
(45) Date of Patent: Jun. 28, 2022

(54) FINGER CONNECTING FLUTE ATTACHMENT WITH FINGER REST PAD

(71) Applicant: David Garland Harris, Manlius, NY (US)

(72) Inventor: David Garland Harris, Manlius, NY (US)

( * ) Notice: Subject to any disclaimer, the term of this patent is extended or adjusted under 35 U.S.C. 154(b) by 0 days.

(21) Appl. No.: 15/870,970

(22) Filed: Jan. 14, 2018

Related U.S. Application Data

(60) Provisional application No. 62/446,401, filed on Jan. 14, 2017.

(51) Int. Cl.
*G10D 9/00* (2020.01)
*G10G 5/00* (2006.01)
*G10D 7/026* (2020.01)

(52) U.S. Cl.
CPC ..... *G10D 9/00* (2013.01); *G10D 7/026* (2013.01); *G10G 5/005* (2013.01)

(58) Field of Classification Search
CPC ..... G10D 9/00; G10D 7/026; G10G 5/005
See application file for complete search history.

(56) References Cited

U.S. PATENT DOCUMENTS

| | | | | | |
|---|---|---|---|---|---|
| 2,847,892 | A * | 8/1958 | Laas | G10D 9/00 | 984/139 |
| 2,933,968 | A * | 4/1960 | Hearne, Jr. | G10D 7/066 | 84/382 |
| 3,988,958 | A * | 11/1976 | Brunkow | G10D 9/00 | 84/453 |
| 4,348,935 | A * | 9/1982 | Bay | G10D 9/00 | 84/382 |
| 4,763,556 | A * | 8/1988 | Peplowski | G10D 7/026 | 84/453 |
| 9,524,705 | B2 * | 12/2016 | Pittel | G10G 5/005 | |
| 10,041,613 | B1 * | 8/2018 | Gill | F16L 17/035 | |
| 10,410,613 | B2 * | 9/2019 | Harris | G10G 5/005 | |
| 11,132,982 | B1 * | 9/2021 | Drapkin | G10D 7/066 | |
| 2007/0044635 | A1 * | 3/2007 | Lee | G10D 7/026 | 84/384 |
| 2018/0211642 | A1 * | 7/2018 | Harris | G10G 5/005 | |

* cited by examiner

*Primary Examiner* — Robert W Horn

(57) ABSTRACT

The instant invention relates to new attachments for the round tubular body of flutes. It attaches firmly, but removably, to the flute and stabilizes the relation between the flute and the player's left index finger (and/or thumb) without pressure on the player's mouth, which enhances the flexibility of the player's lips to more perfectly play the flute. This is especially beneficial for the player's lower lip, which, under extant art, is forcibly pinned against the lower teeth and gums to stabilize the flute. This invention comprises a finger connector and a spacer attachment to the flute, constituting a comfortable surface for the base of the left index finger and an opening through which the flute player's left index finger (and/or thumb) is inserted, as like wearing a ring.

19 Claims, 8 Drawing Sheets

FINGER CONNECTING FLUTE ATTACHMENT WITH FINGER REST PAD

CROSS-REFERENCE TO RELATED APPLICATIONS

This application claims the benefits and priority of Provisional Patent Application, 62/446,401, filed at 15:20:22 Eastern Time on 14 Jan. 2017, by the present inventor, which is incorporated by reference.

FEDERALLY SPONSORED RESEARCH

None.

SEQUENCE LISTING

None.

BACKGROUND ART

A recurring problem in playing the flute is the awkward positioning required of the hands and fingers for the proper control and operation of the musical instrument, which has an innate tendency to roll because of imbalance from the weight of the keys and other parts of the flute's operating system. Because the player must rapidly shift fingerings between all keys of the flute being depressed to some or all keys being open, producing radically changing support of the flute from the player's fingers, the stability of the flute is imperiled. This instability is reflected both in the difficulty of maintaining the ideal relation between the lips and the flute so as to produce the most perfectly formed notes and in the difficulty of changing fingerings quickly and reliably while also preventing the flute's rolling away from its ideal position.

Per the current state of the art, to stabilize the flute force is applied by the side of the left index finger that in turn transfers appropriate pressure of the flute mouthpiece against the flute player's lower lip. To create this pressure, the digits of the right hand press the flute outward, which, via the base of the left hand index finger acting as a fulcrum, transfers pressure to the player's lower lip. To hold the flute so as to avoid untoward movement of the instrument considerable pressure must be exerted. Maintaining such substantial, constant, balanced, stabilizing pressure, given the rapid and extreme variations in support provided by the player's fingers as different notes are played, is problematic and not always successfully accomplished, leading to the flute rolling about, and incorrect and/or poor quality notes being played.

A variety of hand-positioning techniques are advocated in the literature for better stabilizing the flute against unintended rolling, such as the Rockstro hand position. None of these prescriptions serve other than to reduce the flute's instability a bit, and a serious drawback of current flute playing techniques and all extant prescriptions for mitigating this difficulty is the need for substantial pressure to be exerted by the flute mouthpiece against the player's lower lip. For example, the Rockstro hand position is based on considerable additional pressure being applied by the player's right thumb to the side of the flute nearest the player, more forcefully leveraging it against the fulcrum of the base of the index finger, which contacts the flute's side furthest from the player, creating substantial pressure against the player's lower lip sufficient to more firmly fix the position of the flute and reduce its rolling in the player's hands. Such hand positions evidence several problems. First, they require an awkward and unnatural positioning of the thumb. The thumb is much more naturally positioned on the bottom of the flute than against its side. Second, such hand positions require substantial steady pressure, which is difficult to maintain when moving the other fingers of the right hand, and which is exacerbated by the fatiguing hand position noted above. Third, the substantial pressure against the base of the index finger of the left hand is painful and fatiguing after a time, both limiting continuous practice and performance time and being a cause of playing errors. The necessary pressure is so great that it is common, if not universal, among experienced flute players for a substantial callus to form on their left hand at the point where the base of index finger presses against the flute. Fourth, and most problematic, such hand positions rely upon even greater pressure being applied by the flute to the player's lower lip, limiting the flexibility of the lips to shape and form notes in the most ideal way, which is especially problematic given the need of a flute player to widely, flexibly and quickly alter the shape of their lips, their embouchure, in order to best play all of the notes of the flute.

The provision of solid, stable flute-finger and flute-thumb connectors permits much more stable and certain control of the flute while playing, no matter the complexity of fingering any sequence of notes. When using both the index finger and right thumb connectors it is possible to retain and control the position of the flute with no pressure on the lower lip or the base of the left index finger whatsoever and with no other body parts of the player in contact with the instrument. This stabilizing support being independent of operating the flute permits finger changes for any sequence of notes with little or no effect on the stability of the flute or its position relative to the player's lips. Separating the amount of pressure applied to the player's lower lip from operating, controlling, and stabilizing the flute permits the player to completely flexibly employ both the lower lip and the upper lip so as to create the most pleasing notes possible. Even beyond this very substantial benefit is the effect of the instant invention of providing absolutely greater stability and control of the instrument, thereby facilitating quicker, more accurate and more consistent complex fingering changes both by reducing pressure on critical fingers and by generally increasing the stability of the instrument in the player's hands. Similarly, with less pressure required, playing the flute for an extended time period is less fatiguing and painful.

Another very substantial benefit of the instant invention over extant art is that it allows the flute to be safely played by children without fear of distorting the proper development of their gums and teeth. Many parents permit their children to start their music education only with a piano or a violin because wind instruments generally put severe stress and strain on the mouth, teeth and gums, which can distort their development. Because the instant invention permits, even encourages, the best use of the flute to be without strong, or even any, pressure on the teeth and gums, a flute so equipped can be used even by young children without orthodontia concerns.

Prior art in this area consists only of add-on aftermarket enhancements to the flute that do no not anticipate or even imply the enhancements comprising the important contributions to the art of the instant invention. Tanabe, U.S. Pat. No. 8,269,086 B1, provides a ring for the player's finger with friction pads that touch the flute. However, this device only helps to create some additional friction between the player's hand and the flute, but does not serve to fix that relation in any definite or necessary way, and neither does it reduce substantially the pressure against the player's lower lip needed to stabilize the flute. For example, the instant device of the current invention is so stable that a player can hold the flute utilizing only the left index finger and the thumb of the right hand, and without touching the flute to their chin or lips, as the current invention allows the player to otherwise support the flute without the use of any other fingers or pressure points. Additionally, Tanabe's device does not establish the consistent placement of the player's hand in relation to the flute because it is not fixed to the flute, but to the player's hands. With the flute-finger connector of the instant invention, after a player removes their hands, the flute can be re-deployed instantly by merely inserting the correct digits into the ring-openings and playing.

Peplowski, U.S. Pat. No. 4,763,556 provides a rest and spacer for the index finger of the left hand and a similar rest for the thumb of the right hand. Ho Fan Lee, patent application number Ser. No. 11/349,197, provides a somewhat similar device to that of Peplowski, but with a small amount of additional support for the thumb of the right hand. While both devices assist in proper placement of the hands, and in permitting better playing, neither addresses the inherent instability of the flute caused by the various shifting fingerings and the lack of secure connection between the player and the flute which results in the flute rolling about as the player switches fingerings to produce various notes. And, none addresses the problem of proper control of the instrument necessitating substantial pressure on the player's lower lip, teeth, and gums.

Harris, in contemporary art, Provisional Patent Application, 62/446,394, filed at 14:14:01 EST on 14 Jan. 2017, discloses a related invention comprising a tubular flute which is manufactured with a flute-finger connector device. This differs materially from the instant invention in that it does nothing to address the issue of extant flutes' lack of such support because it does not provide for a stand-alone attachment that can be removably affixed to existing flutes.

Harris, in contemporaneous art, Provisional Patent Application, 62/446,407, filed at 16:25:14 EST on 14 Jan. 2017, discloses a related device. In that application is described an attachment to existing flutes comprising a flute-finger connector of a discontinuous ring mounted on arms running parallel to the flute, removably attachable to an existing flute in a variety of ways, a number of which are shown in the PPA. Of critical importance to the instant invention, this device does not have a built in finger rest or spacer for offsetting the player's left hand. Omitting a spacer/finger rest is an important distinction in that it permits the player's left hand to operate the flute exactly how it would have been operated without the device because the player's left index finger rests on the flute itself, as opposed to on a pad as herein. This is claimed to enhance the ability of players to adopt this enhancement with minimal change in their playing techniques. It is also a much simpler and less expensive device to produce.

Guenther, U.S. Pat. No. 444,830 A shows a vertically-played flute with hooks provided for the player's thumbs so as to better hold the flute in that position. This arrangement is common for vertically-played instruments such as clarinets, saxophones, etc. The instant invention is quite novel with respect to these devices as they would not function as it does with a transversely played flute. They serve only to prevent the downward movement of an instrument when it is held vertically and would serve no purpose with a horizontal instrument.

OBJECT OF THE INVENTION

It is therefore an object of the present invention to provide new attachments for the tubular body of flutes which permits stabilizing the flute without undue, or even any, pressure on the player's lower lip while also facilitating complex fingering changes and also providing for both a more comfortable hand position and a more comfortable rest for the player's left index finger (and thumb).

DISCLOSURE OF THE INVENTION

In order to accomplish these results, the present invention, in the preferred embodiment, provides a resilient elastic clamp or clip attachment formed with an open circular arc greater than a half circle constructed and arranged for clipping onto the round tubular flute body where the left index finger of a flute player normally rests against the flute body. The resilient clip is formed with a digit rest surface and a spacer which displaces or spaces the digit rest surface an optimal distance from the flute body. Built into or attached onto this removable spacer is a ring-like flute-finger connector, either the index finger of the left hand or the thumb of the right hand.

In a preferred example embodiment, the resilient elastic clip or clamp is constructed and arranged for clipping onto the round tubular flute body between the upper C# tone hole and the upper C finger key for resilient elastic retention. The resilient clip is positioned where the side of the left index finger of a flute player normally rests against the flute body for multiple functions of the left index finger as a pivot point, pressure point and operating finger for the upper C key. To this end the resilient clip is shaped with skewed, irregular, or off center side lobes for elastic retention on the flute body without interfering with the adjacent tone holes or finger keys, with a ring built into it properly centered and set at an appropriate angle for flute stabilization and comfortable and effective index finger function.

The spacer element or spacer portion of the clip is formed with a comfortable and appropriate thickness to offset or displace the left index finger of a flute player in the radial direction from the flute body a sufficient amount to minimize or avoid cramping and fatiguing of the left index finger and left wrist of a flute player. At the same time the left index finger is free to perform the multiple functions of pivot point, pressure point, and upper C key operations, while also providing great stability and resistance to inadvertent rotation of the flute because of the additional anti-rotational force that is applied to the flute by the player's left index finger via its ring-like flute-finger connector.

For the left index finger device, the finger rest surface and spacer are offset around the circular arc of the clip or clamp from the center of the arc for optimum positioning where the side of the left index finger normally rests against the flute body. The clip or clamp may be formed as an integral piece: for example, molded of a relatively soft but elastic plastic with good memory such as PVC plastic which does not mar the surfaces of the flute. According to another embodiment, the attachment could be via a pinch-type clamp where the ends are squeezed to relieve its pressure, and released so that the clamp affixes to the body of the flute. In all embodiments, a flute-finger connecting ring or ring-like opening, either movable or fixed, either partial or continuous, adjustable or of fixed circumference, and either permanently or removably affixed to the spacer, is built into or attached to the spacer so as to firmly connect the flute to the player's hands.

According to another embodiment of the invention, the attachment is constructed and arranged for fastening onto the undersurface of the round tubular flute body between the E and F tone holes of the flute. In this example, the digit rest surface and spacer are positioned on the undersurface of the tubular flute body where the right thumb of a flute player normally rests against the flute body. An appropriate ring or other retention device, such as a ring or a clip into which the tip of the thumb may be inserted, is attached so as to anchor the flute with the thumb in a natural position. The spacer is formed with sufficient thickness to displace or offset the digit rest surface and thumb in a comfortable position.

BRIEF DESCRIPTION OF THE DRAWINGS

FIGS. 16 and 17 shows how rings of different diameters can be fit into the same rest surface, when the spacing between slots is of sufficient width.

DESCRIPTION OF PREFERRED EXAMPLE EMBODIMENTS AND BEST MODE OF THE INVENTION

Figure 1:
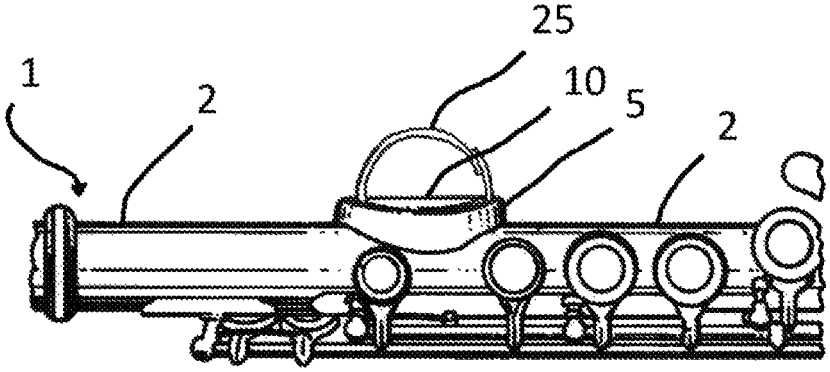
FIG. 1 is a fragmentary side view of a flute showing a left index finger flute-finger connector comprising a spacer and a clip flute-attachment with ring-like adjustable-size opening in place between the upper C# tone hole and upper C finger key.
Figure 1A:
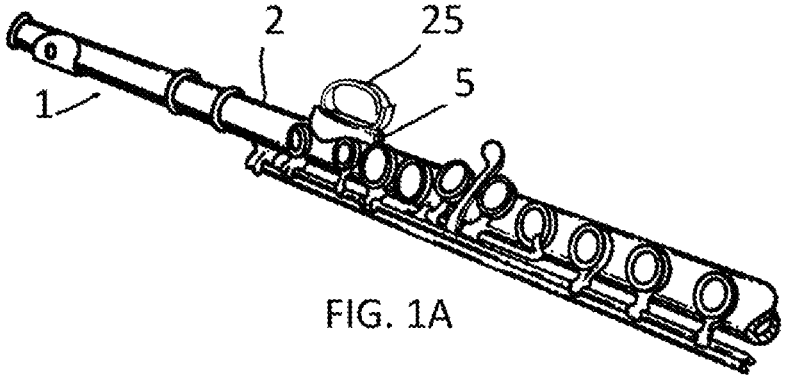
FIG. 1A is a more distant fragmentary environmental perspective view of the flute in the direction of the flute head showing the position of the invention comprising a flute-finger connector adjustable ring-like opening in relation to the flute head and alternatively viewed with the finger rest surface and spacer clipped to the tubular flute body.
Figure 2:
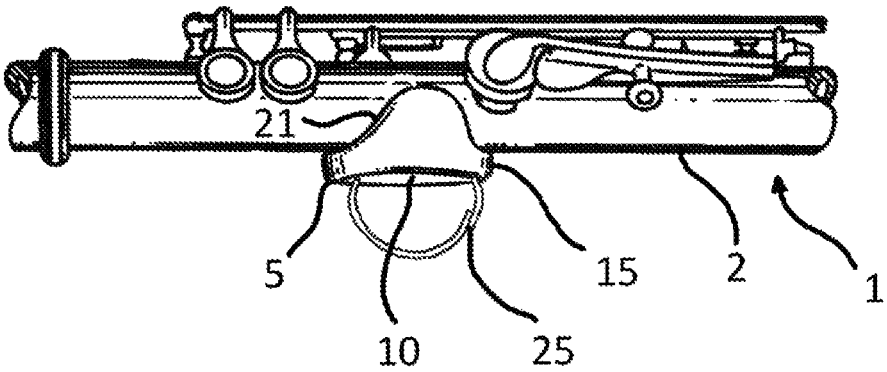
FIG. 2 is a fragmentary side view of the flute of FIG. 1 from the other side showing the same left index finger spacer clip with its flute-finger connecting adjustable ring-like opening in place with attachment by resilient, flexible lobes.
Figure 3:
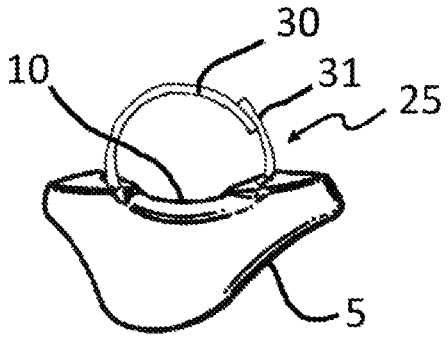
FIG. 3 is a side view of the flute-finger connector with resilient flexible attaching lobes.
Figure 4:
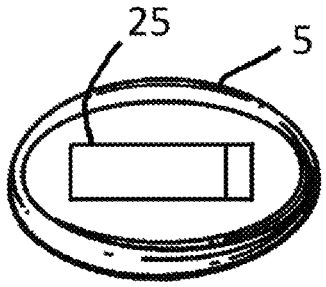
FIG. 4 is a plan view from above of the device shown in FIG. 3.
Figure 5:
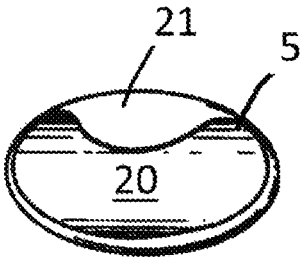
FIG. 5 is a plan view looking from below at the inside of the flute-finger connector, showing the undersurface of the spacer clip that engages the tubular flute body.
Figure 6:
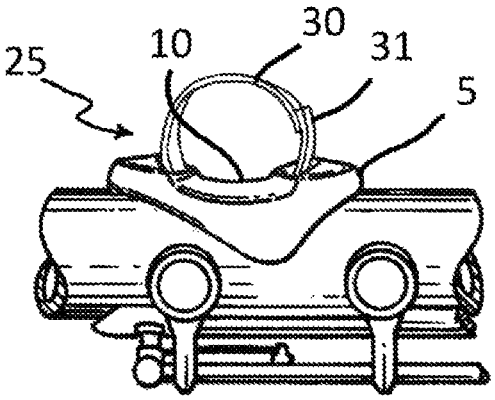
FIG. 6 is a side view of the flute-finger connector with a saddle shaped finger rest surface attached to the flute.
Figure 7:
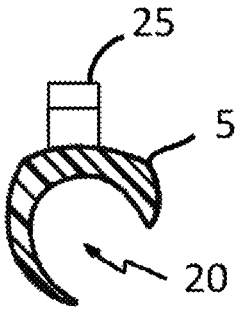
FIG. 7 is a horizontal cross section view through the saddle shaped finger rest surface of the flute-finger connector.
Figure 8:
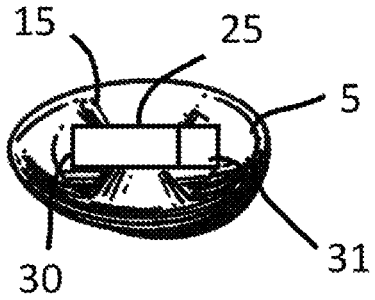
FIG. 8 is a plan view of the saddle shaped finger rest surface and ring-like opening of the flute-finger connector.
Figure 9:
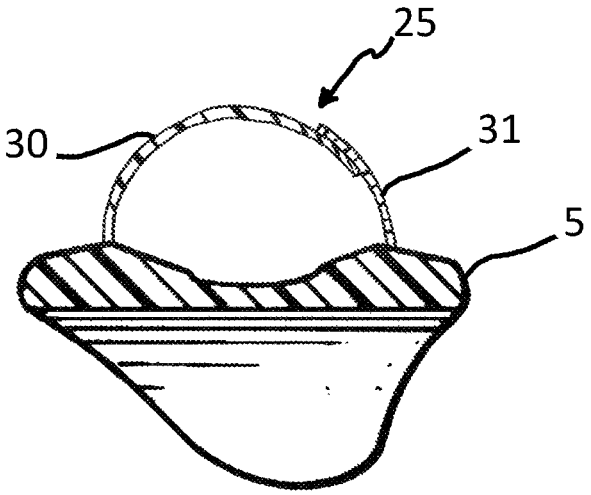
FIG. 9 is a longitudinal cross section view through the saddle shaped finger rest surface of the flute-finger connector with ring-like opening.

A left index finger flute-finger connector, 25, and spacer clamp or clip attachment, 5, is shown in FIGS. 1 and 2, comprising easily removable resilient lobes for attachment to the flute, in position on the round tubular body, 2, of a standard flute 1. Plan views of the finger rest and spacer clip, 5, from the side, above, and below separated from the flute are shown in FIGS. 3, 4, and 5. The spacer clip, 5, is formed with a smooth, or ergonomically shaped, finger rest surface, 10. The spacer, spacer element or spacer portion, 5, displaces or offsets the finger rest surface, 10, from the round tubular flute body 2 for more favorable positioning of the left hand, and left wrist and the flute-finger connecting ring, 25, allows the flute player to better stabilize the flute without impeding its operation in any way.

Referring to FIGS. 4-7, the spacer clip attachment grasps the tubular body of the flute by means of an open circular arc, 20, greater than a half circle formed on the undersurface of the clip. The actual location of the finger rest surface, 10, is offset from the center of the arc, 20, for optimum positioning of the left index finger relative to the flute body. The actual thickness of the spacer, 5, at the center of the finger rest surface, 10, offset from the center of the arc, may be of any appropriate, comfortable thickness. The left hand and wrist thereby are more favorably oriented in a natural position to minimize fatigue and cramping. The spacer can be covered with a soft pad and ergonomically shaped so as to distribute the contact pressure of the flute across the base of the index finger so as to considerably reduce the pressure in comparison to that of the very hard and smaller diameter flute tube. The provision of the flute-finger connecting ring-opening design permits the flute player to better stabilize the flute.

Because the radius of curvature of the cylindrical curvature configuration finger rest surface, 10, is different from the radius of curvature of the arc 20, the thickness profile tapers to a greater thickness on either side of the middle of the finger rest surface, 10.

Referring to FIG. 3 the ring in the preferred embodiment is composed of two overlapping malleable, bendable arms, 30 and 31. This permits the size of the ring-like opening easily to be adjusted for proper fit simply by bending the arms. This adjustment can easily be made more permanent by the judicious application of a more or less permanent bonding medium to the overlap between the arms.

Referring to FIG. 2 it is noted that the finger rest surface, 10, of the clip extends over an appropriate distance between the upper C finger key and the upper C# tone hole so as to permit a comfortable support with the flute-finger connector attachment. As also clearly shown in FIG. 2 the spacer clip, 5, is formed with a skewed or off center lobe, 21, on one side for elastic retention to the tubular body, 2, without interfering with adjacent finger keys and tone holes.

Figure 10:
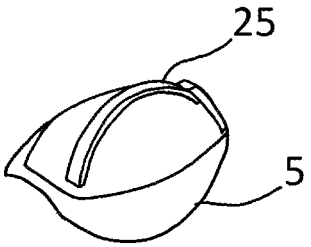
FIG. 10 is a more distant environmental view of the flute-finger connector with ring-like opening for the thumb.
Figure 11:
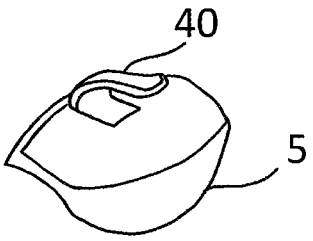
FIG. 11 is more distant environmental view of the flute-finger connector with a clip under which a player's thumb is inserted to stabilize the flute substituted for a ring.
Figure 12:
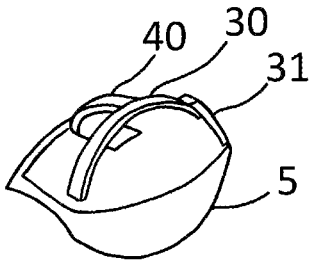
FIG. 12 is more distant environmental view of the flute-finger connector with both an adjustable ring and an adjustable clip, when constructed of malleable material. This embodiment connects the player's thumb to the flute in all dimensions.

FIGS. 10-12 show the flute-finger connecting device for the thumb. They show different possible configurations for retaining the thumb in a fixed and supportive relation to the flute so as to better stabilize it.

Figure 13:
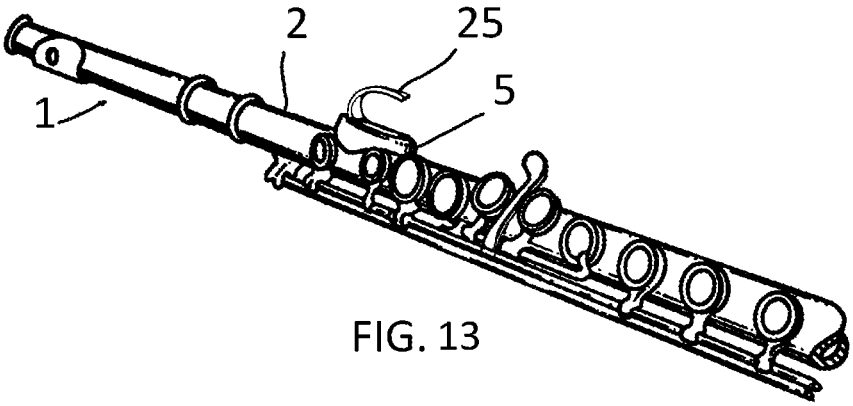
FIG. 13 is a more distant fragmentary environmental view of the flute with attached flute-finger connector and ring-like opening for the left index finger comprising a partially open ring, 25.

FIG. 13 depicts the flute-finger connector with a partial ring. This permits quicker entry and exit from the device and also permits somewhat easier adjustment as only the single arm, when made of malleable material, need be bent.

Figure 14:
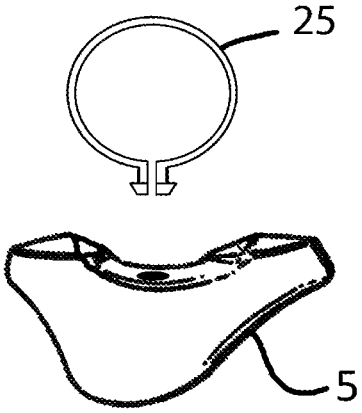
FIG. 14 is a side view from the left index finger flute-finger connector with ring-like opening removed from the flute, but in this refinement the ring, 25, is detachable from the finger spacer, 5, and interchangeable with rings of other dimensions, and, depending on its relation to the surface of the finger spacer more or less rotatably movable when attached.

FIG. 14 shows an embodiment of the flute-finger connector with a removable and interchangeable ring. This makes altering the device to fit different players' hands both easy and quick.

Figure 15:
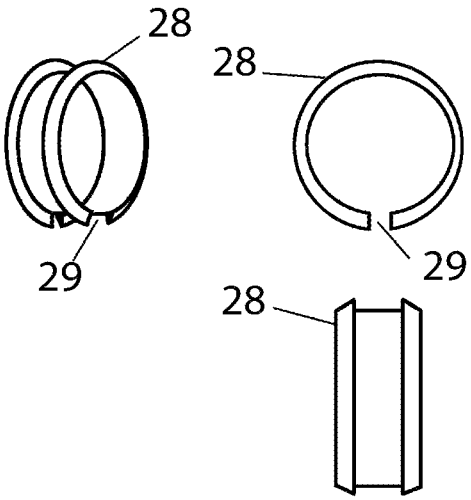
FIG. 15 shows three views of an insert, 28, made from flexible material with good memory with a gap, 29, of appropriate size such that the sides of the insert can be squeezed toward one another and the insert placed inside of a ring. On releasing pressure on the sides of the insert it will re-expand to its normal size and the flanges along its edges lock it removably into the ring. With removable inserts of varying thickness the inside diameter of the flute-finger connector ring-like part easily can be altered to accommodate fingers of many different sizes. Greater player comfort and facility can be achieved if the inner surface of the insert is made of a soft elastic material.

FIG. 15 shows several views of an insert ring that can be used in conjunction any fixed ring. That is, a somewhat oversized, fixed ring can be adjusted by inserting such a ring as shown in FIG. 15 of appropriate thickness.

Figure 16:
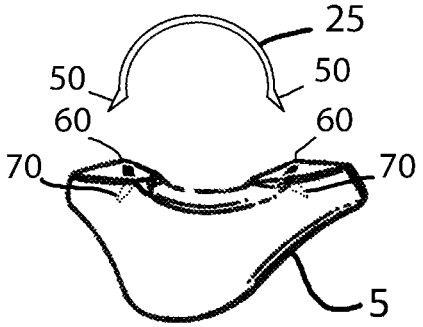
FIG. 16 depicts the flute-finger connector with a detachable ring. This ring fits into slots in the spacer rest surface, permitting rings of differing sizes to be employed.
Figure 17:
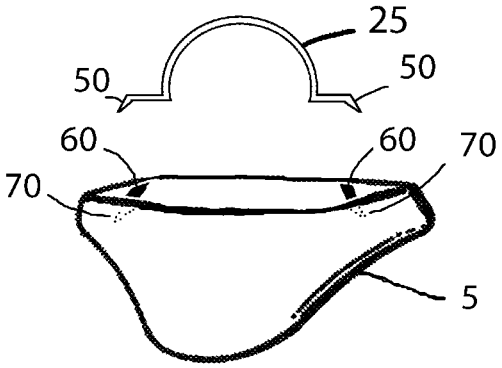
FIG. 17 depicts an embodiment of the flute-finger connector similar to FIG. 16, but with a flat as opposed to an ergonomically formed rest surface. Comparing

FIGS. 16 and 17 show interchangeable ring parts and demonstrates how different sized rings can be accommodated by a single spacer clip, if sufficient width is provided between the rest surface attachment points, 60.

Figure 18:
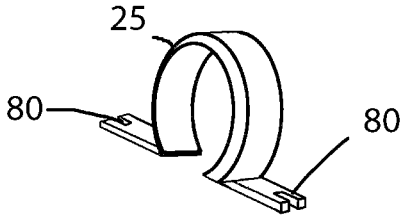
FIG. 18 shows the ring-like portion of another embodiment of the flute-finger connector. In this example, the ring-like portion has notches cut into its base for fitting onto corresponding pegs located on the spacer's rest surface.
Figure 19:
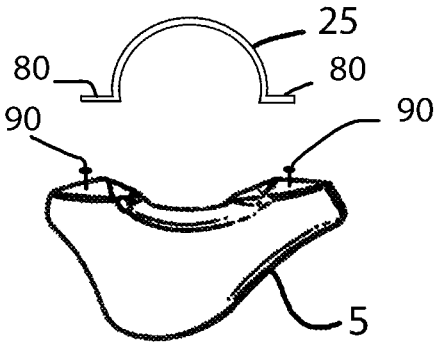
FIG. 19 shows the combination of the ring-like device and the spacer flute-attachment device, which, together, comprise an embodiment of the instant invention. This shows the pegs on the rest surface of the spacer to which the ring-like portion of the invention can be removably fastened. This permits interchanging rings of different diameters.

FIGS. 18 and 19 show a system of interchangeable ring parts, similar to FIGS. 16 and 17, but utilizing a ring part with notches, 80, cut into its base. If the ring is compressed slightly and placed between the mounting pegs, 90, on the surface of the spacer clip, then on releasing the pressure, the ring part will expand and removably lock onto the spacer surface. This permits simple and inexpensive adjustment of the device to fit many different players' hands by the use of variously sized ring parts.

Figure 20:
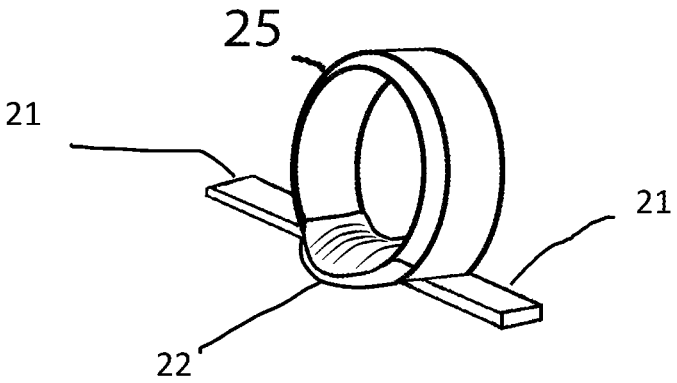
FIG. 20 shows an embodiment of the invention which permits a variety of attachments to the flute. It comprises only a ring-like portion, a rest surface/spacer, and arms. It can then be attached to a flute by, for example, cable ties, elastic bands, or any other tensionable device circumnavigating the circumference of the flute's tubular body. Because the attachment device is extraneous to the invention, and variable as to the length of its arms, this permits this embodiment to be attached to many different kinds of flutes, such as alto, bass, treble, and even piccolos.

FIG. 20 shows a simplified and inexpensive version of the flute-finger connector. In this embodiment no provision for attachment to the flute is provided. Rather, it is constructed so that extraneous attachment devices, common to extant art, can be utilized, such as cable ties, elastic bands, or any device that can circumnavigate the body of the flute with sufficient tension. If the arms, 21, of this device are of proper length, then it can be fitted to many, if not all, different kinds of flutes as it can be attached independent of the specific circumference of the flute's tubular body.

Figure 21:
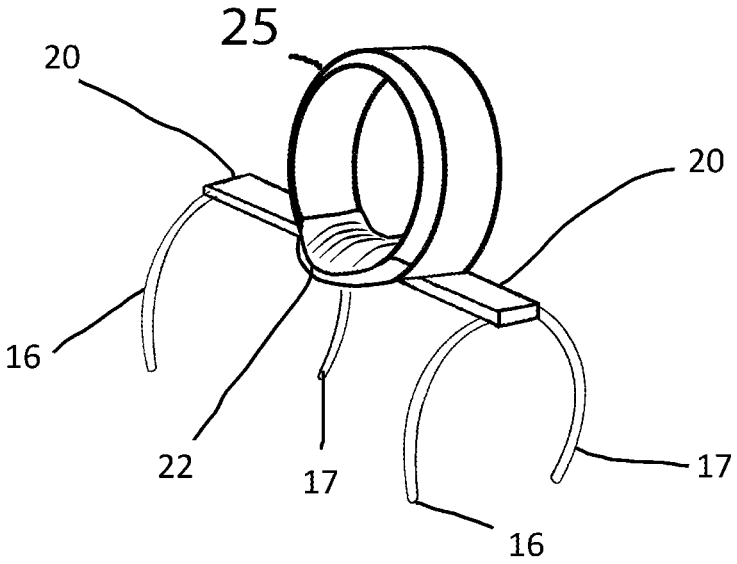
FIG. 21 shows an embodiment of the invention which attached to the flute with two arms of material of good memory. It comprises only a ring-like portion, a rest surface/spacer, and attachment arms.

FIG. 21 shows a device similar to the embodiment shown in FIG. 20, but with attachment arms, 16 and 17, made of memory retaining, flexible material, and properly spaced to as to attach to a flute without interfering with its operation.

Figure 22:
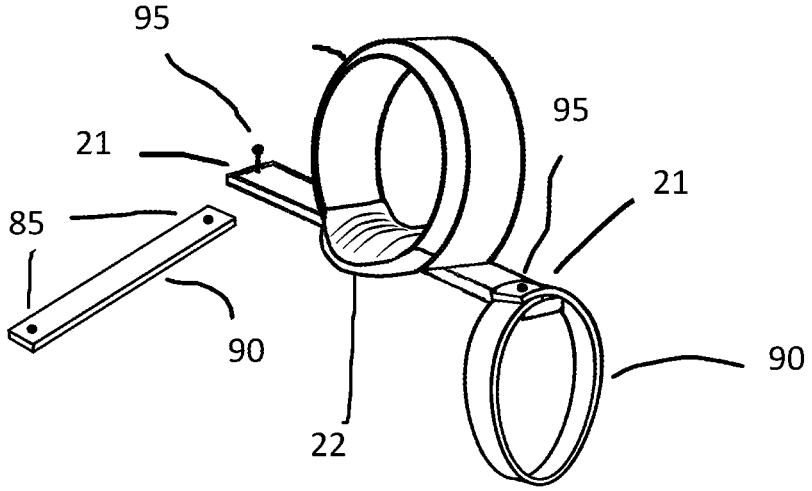
FIG. 22 shows an embodiment similar to those shown in FIGS. 20 and 21, but with attachment to the flute via elastic bands which, after circumnavigating the tubular body of the flute attach to pegs on the ends of the device. By changing the lengths of the attachment elastic bands, the device can be affixed to flutes of various circumferences.

FIG. 22 shows an embodiment of the invention similar to that shown in FIGS. 20 and 21, but with elastic bands, 90, for attachment. These bands, of length less than the circumference of the flute, have holes, 85, in their ends such that after circumnavigating the tubular flute body they are attached to the arms of the device, 21, via pegs, 95.

While the invention has been described with reference to particular example embodiments it is intended to cover all modifications and equivalence within the scope of the following claims. For example, though specific embodiments of the invention include a flute-finger-connecting ring with adjustable arms (FIGS. 1-12) and with differently sized inserts (FIG. 15), many other modifications can also fall within this description such as, non-adjustable rings, adjustable arms comprising overlying plastic strips carrying spaced projecting pegs and holes, adjustable arms comprising hooks and loops, simple ties, or sliding clamps, etc.

I claim:

1. An attachment for flutes having a round tubular flute body formed with tone holes and finger keys, comprising:

a flute-finger connecting attachment for firmly fastening onto the round tubular flute body, without modification of the flute, where the side of the left index finger of a flute player normally rests against the flute body while playing, constructed so as to retain a player's left index finger in fixed relation to the flute to facilitate the multiple functions of the left index finger as pivot point, pressure point and operating finger, said flute-finger connector being removable and relocatable along and around the tubular body to accommodate differing individual hand characteristics and requirements;

said flute-finger connector comprising a comfortable finger rest surface for the side of the left index finger of a flute player and a spacer offsetting the finger rest surface in the radial direction of the tubular flute body away from the flute body, thereby increasing the outer diameter of the tubular flute body at the finger rest surface;

said spacer comprising a thickness to offset the left index finger of a flute player in the radial direction of the tubular flute body outwardly and away from the flute body a sufficient radial distance for minimizing cramping or fatiguing of the left index finger and left wrist of a flute player while permitting the left index finger to perform the multiple functions as pivot point, pressure point, and operating finger;

said flute-finger connector having built into it a left index finger retainer which partially or wholly circumnavigates the flute player's left index finger so as to partially immobilize and solidly connect the flute player's finger to the flute thereby providing rotational and other support of the flute by the player while not impeding the left index finger's performance of its multiple functions as pivot point, pressure point, and operating finger.

2. The flute attachment of claim 1 wherein the left index finger retainer is adjustable with respect to its size.

3. The flute attachment of claim 1 which attaches to the flute body with a part made of a relatively soft but resilient plastic to avoid marring the surface of the round tubular flute body.

4. The flute attachment of claim 1 wherein the finger rest surface comprises a saddle shaped surface.

5. The flute attachment of claim 1 wherein the finger rest surface comprises a soft elastic material.

6. The flute attachment of claim 1 wherein the finger retainer is movably attached to the spacer rest surface so that the finger retainer may move relative to it, permitting the player's index finger greater range of motion and greater comfort while also providing essential support for the flute.

7. The flute attachment of claim 1 wherein the finger rest surface extends over a length of the flute body at least from the upper C tone hole to the upper C finger key and wherein the attachment is by a skewed side lobe for elastic retention on the flute body without interfering with adjacent tone holes or finger keys of the flute.

8. The flute attachment of claim 1 wherein the finger rest surface and spacer are offset around the circular arc of the attachment part from the center of the arc for positioning where the side of the left index finger of a flute player normally rests against the flute body when the device is fastened onto the flute body.

9. The flute attachment of claim 1 which attaches to the tubular flute body by a clamping mechanism.

10. The flute attachment of claim 1 wherein the finger retainer is removable and interchangeable with similar parts of different sizes and/or other differing characteristics.

11. The flute attachment of claim 1, constructed without an integral finger retainer, but which accepts and retains common rings of different sizes; a ring retention mechanism capable of accepting extant fine and decorative jewelry rings.

12. The flute attachment of claim 1 wherein said finger retainer is designed to operate with respect to the thumb, retaining the flute player's right thumb in fixed relation to the flute so as to provide substantial additional support for the flute, and constructed to fit the flute where the player's right thumb would normally rest while playing the flute.

13. The flute attachment of claim 12 wherein said thumb retainer part is removably attached to the flute-finger connector and interchangeable with other thumb retainer parts of differing size or other characteristics.

14. The flute attachment of claim 12 wherein said thumb retainer part is adjustable as to its size.

15. The flute attachment of claim 1 wherein the left index finger retainer is adjustable as to its position on the spacer's finger rest surface.

16. The flute attachment of claim 1, wherein the left index finger retainer is of fixed size, and accepts inserts to reduce its size.

17. The flute attachment of claim 1 wherein the left index finger retainer is adjustable as to its angle in relation to the spacer's surface.

18. The flute attachment of claim 1, constructed without integral provision for attaching to the flute, but so constructed as to be attachable to the tubular flute body by extraneous, extant, attachment devices, such as cable ties.

19. The flute attachment of claim 1, wherein attachment to the tubular flute body is by elastic bands.

* * * * *